US008231171B2

(12) United States Patent
Leng

(10) Patent No.: US 8,231,171 B2
(45) Date of Patent: Jul. 31, 2012

(54) FOLDABLE CHAIR

(75) Inventor: Luhao Leng, Fujian (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 12/811,561

(22) PCT Filed: Nov. 7, 2008

(86) PCT No.: PCT/CN2008/072977

§ 371 (c)(1),
(2), (4) Date: Jul. 2, 2010

(87) PCT Pub. No.: WO2010/051665

PCT Pub. Date: May 14, 2010

(65) Prior Publication Data

US 2011/0198893 A1 Aug. 18, 2011

(51) Int. Cl.
*A47C 4/14* (2006.01)

(52) U.S. Cl. ..... 297/56; 297/41

(58) Field of Classification Search ..... 297/35, 297/40, 41, 55, 56, 57
See application file for complete search history.

(56) References Cited

U.S. PATENT DOCUMENTS 714,562 A * 11/1902 Crandall et al. ..... 297/57
1,945,018 A * 1/1934 Boardman ..... 297/411.32
2,016,385 A * 10/1935 Molling et al. ..... 297/57
2,572,739 A * 10/1951 Madsen ..... 297/57
2,701,007 A * 2/1955 Hickok ..... 297/40
3,220,764 A * 11/1965 Duer ..... 297/56
4,890,881 A * 1/1990 Ollat et al. ..... 297/26
5,464,268 A * 11/1995 Levrangi ..... 297/57
5,542,739 A 8/1996 Hultman
7,857,379 B2 * 12/2010 Leng ..... 297/57

FOREIGN PATENT DOCUMENTS

CN 2678465 Y 2/2005
CN 101396209 A 4/2009
KR 2008-0095824 A 10/2008

* cited by examiner

*Primary Examiner* — Peter R. Brown

(74) *Attorney, Agent, or Firm* — Rabin & Berdo, P.C.

(57) ABSTRACT

A folding chair comprises a cross folding supporting frame with two X-shaped cross folding bars. Each of the cross folding bars has a front and rear leg connected crossly to each other in the middle. The upper portions of the two front legs form a first upper portion and the upper portions of the two rear legs form a second upper portion. The seat has a first and second side which are parallel to each other. The first side is pivotally connected to the first upper portion of a cross folding supporting frame. A supporting bar is disposed in the bottom of the seat and can slide between the first side and the second side. The two ends of the supporting bar are connected to the second upper portion of the cross folding supporting frame. The chair folds by a supporting bar sliding along the bottom of the seat.

5 Claims, 12 Drawing Sheets

FOLDABLE CHAIR

FIELD OF THE INVENTION

The present invention relates to a chair, more particularly, to a foldable chair and a foldable chair with armrest.

BACKGROUND OF THE INVENTION

Traditional foldable chairs accomplish the folding process by forming a four-bar linkage consisted of front legs, rear legs, a seat frame bar and a connecting member, the rear legs are shorter than the front legs and the top end of the rear leg pivotally connected to the middle-upper portion of the front leg, the middle-rear portion of the seat frame bar pivotally connected to the middle portion of the front leg, one end of said connecting member connected to near rear end of the seat frame bar and the other end of said connecting member pivotally connected to near upper portion of the rear leg. When the foldable chair unfolded completely, said connecting member abut upper to the protrusion disposed on one side of the seat frame bar, thus the seat is fixed to a horizontal position, in this completely unfolded state, said protrusion is below the portion between the two ends of said connecting member, the gravity of the user is mainly in the middle-front portion of the seat, the protrusion ensure that the rear end of the seat frame bar will not be upturned and the middle-front portion will not be droop.

Another folding mechanism of the foldable chair is: the upper end of the front leg pivotally connected to the front end of the horizontal lever, the middle portion of the front leg crossly and pivotally connected to middle-lower portion of the rear leg, the horizontal lever slidably and rotatably connected to the approximately middle portion of the rear leg along the length direction, said horizontal lever used for supporting the seat. When the connecting portion of the rear leg set for connecting the horizontal lever is slide to the utmost front position, the folding mechanism is in folded state, on the contrary, it is in unfolded position.

As to the folding mechanism of the first type, one of the mainly stress-points in the use status is the connecting point between the connecting member and the protrusion of the seat frame bar, therefore, the connecting between the protrusion and the seat frame bar is very important, or else the seat can not be supported stably. As to the mechanism of the second type, the connecting portion between the rear leg and the horizontal bar is one of the mainly stress-points, maintain the stability of the connecting portion is difficult, thus can be seen, the folding mechanism of the prior art are not stable and reliable enough.

SUMMARY OF THE INVENTION

The primary object of the present invention is to obviate the disadvantages of the folding mechanism of the prior art chair being not stable and reliable enough.

This and other objects can be achieved by providing:

A folding chair comprising a cross folding supporting frame comprising two X-shaped cross folding bars, each of said X-shaped cross folding bar comprising a front leg and a rear leg connected crossly to each other in the middle portion, The upper portions of the two front legs formed a first upper portion, the upper portions of said two rear legs formed a second upper portion; a seat having a first side and a second side which are parallel to each other, wherein the first side or near first side pivotally connected to the first upper portion of said cross folding supporting frame; a supporting bar, disposed in the bottom of said seat, can slide between the first side and the second side, the two ends of said supporting bar connected to the second upper portion of said cross folding supporting frame; and when the foldable chair is in the unfolded position, both of the supporting bar and the said first upper portion supported the seat to maintain in a horizontal level.

The bottom of said seat having a supporting bar which can slide between the first side and the second side, and the two ends of said supporting bar connected to the second upper portion of said cross folding supporting frame.

The first side and second side of the seat are the front side and rear side of the seat respectively, a bar-shaped member extending along the front-rear direction of the seat is disposed both in the bottom of the left side and in the bottom the right side respectively, the two bar-shaped members formed two sliding grooves with the seat, said supporting bar pass through the two sliding grooves along left-right direction.

Further, said two front legs are in the outside of said two rear legs, the length of said supporting bar is larger than the distance between the two rear legs and smaller than the distance between the two front legs.

The upper portion of said two front legs integrate with each other by a transverse bar, said transverse bar rotatably connected to the first side or near first side of said seat; the upper portion of said two rear legs extending upwardly to form two back bars, a back cushion is disposed between said two back bars, the two ends of said supporting bar welded to the front-upper portion of the upper portion said two rear legs.

Another Solution:

A foldable chair comprising a cross folding supporting frame comprising a pair of X-shaped cross folding bars each comprising a front leg and a rear leg connected crossly to each other at the middle portion respectively, the upper portions of the two front legs formed a first upper portion, the upper portions of said two rear legs formed a second upper portion, the upper portions of said two rear legs extending upwardly to form two back bars, aback cushion is disposed between said two back bars; a seat having a first side and a second side which are parallel to each other, wherein said first side or near first side pivotally connected to the first upper portion of said cross folding supporting frame, the left side and right side of said seat formed slidable and rotatable connection with said two rear legs respectively; the foldable chair further comprising armrest bars and armrest supporting bars, the rear end of said armrest bar pivotally connected to said back bar, the front end pivotally connected to the upper portion of said armrest supporting bar, the lower end of said armrest supporting bar pivotally connected to the second side of said seat. A supporting bar, disposed in the bottom of said seat, can slide between said first side and second side, the two ends of said supporting bar connected to the second upper portion of said cross folding supporting frame; and when the foldable chair is in the unfolded position, said supporting bar support the seat to maintain in a horizontal level with said first upper portion.

Further, the two ends of said supporting bar welded on the front-upper portion of the upper portion of said two rear legs.

each the left and right side of said seat having a sliding groove respectively, and the corresponding position of each rear leg having a sliding block, said sliding block insert into said sliding groove to form a slidable and rotatable connection between said seat and said rear leg.

The foldable chair has two armrest bars, the rear end of each said armrest bar pivotally connected to the outside of said two back bars respectively, said armrest supporting bars has two correspondingly, the upper end of each armrest supporting bar pivotally connected to the inner sides of said two armrest bars respectively.

The first side and second side of said seat are the front side and rear side of the seat respectively, the lower ends of said two armrest supporting bars integrated with—each other via a transverse bar, said transverse bar rotatably connected to the second side of said seat; the two rear legs positioned between the left side of said seat and the left armrest supporting bar, and between the right side and the right armrest supporting bar respectively.

By above-mentioned description of the present invention, compared to the prior art, the present invention has following advantages: firstly, the folding of the foldable chair is accomplished by the supporting bar sliding in the bottom of the seat, in use state, the pressure of the seat pressed both on the upper ends of the two front legs and on the supporting bar, and the pressure is transferred to the two rear legs by the supporting bar, because the supporting bar pass through the bottom of the seat along left-right direction, thus the sustainable force of the seat is increased greatly, therefore the stability of the foldable chair is improved; Secondly, the two armrest bars and the two rear legs and seat are connected skillfully to make that the armrest bars can be folded with the folding process of the foldable chair, thus the foldable chair with stable structure has foldable armrests.

DETAILED DESCRIPTION OF THE PREFERRED EMBODIMENTS

Hereinafter, preferred embodiments of the present invention will be described with reference to the accompanying drawings.

Embodiment 1

Figure 1:
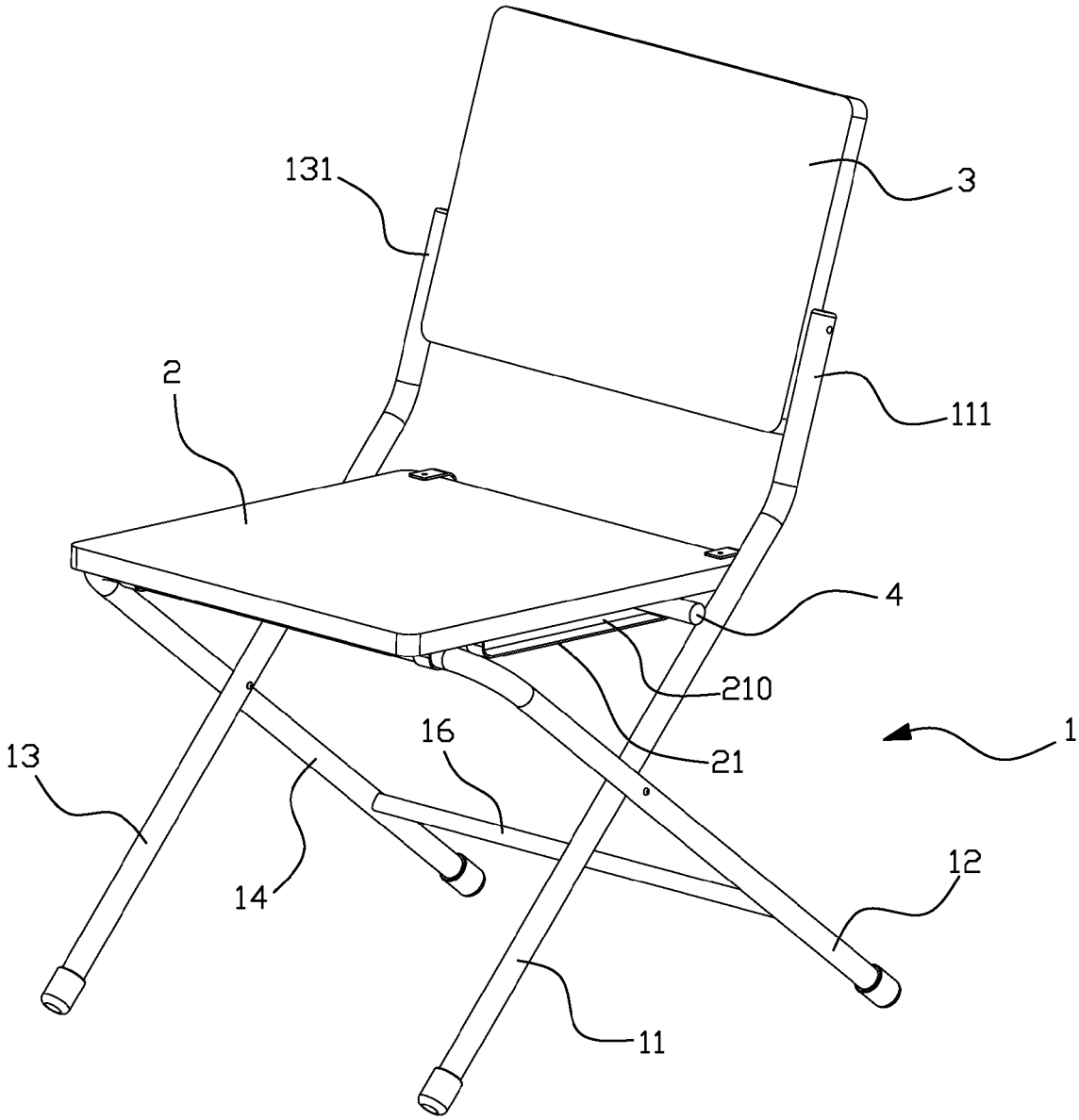
FIG. 1 is a perspective view of the present invention in embodiment 1, shows the using state.
Figure 2:
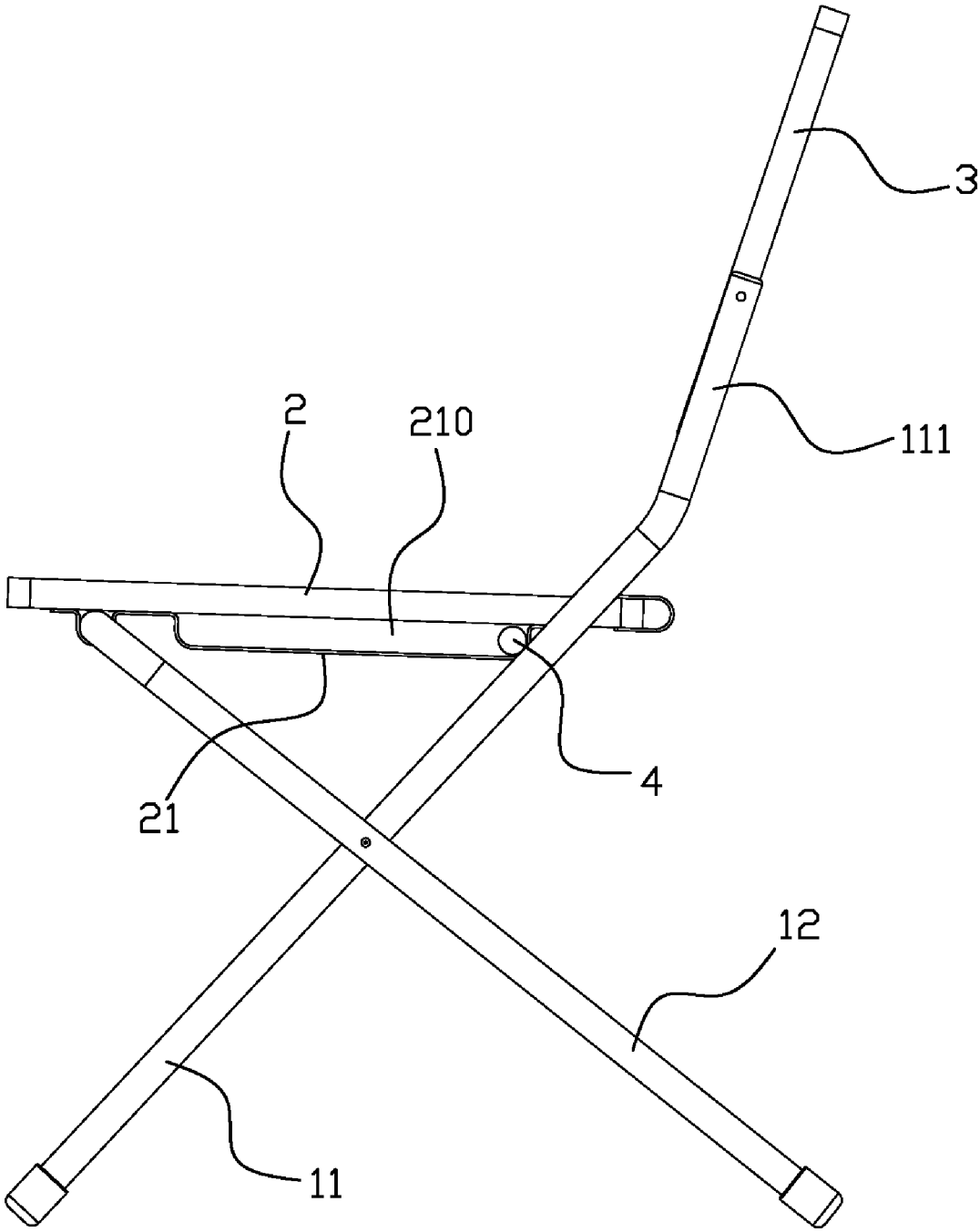
FIG. 2 is a side view of the present invention in embodiment 1, shows the using state.

Referring to FIG. 1 and FIG. 2, a folding chair comprising a cross folding supporting frame 1, a seat 2 and a back cushion 3, the cross folding supporting frame 1 comprising two X-shaped cross folding bars, each of said X-shaped cross folding bar comprising front legs 12, 14 and rear legs 11, 13, they connected crossly at the middle portion, the upper portion (i.e. the front portion) of the two front legs 12, 14 formed a first upper portion of the cross folding supporting frame 1, the upper portion (i.e. The rear portion) of said two rear legs 11, 13 formed a second upper portion of the cross folding supporting frame 1, the first upper portion and the second upper portion can abut against to each other. The upper portion of the two front legs 12, 14 integrate with each other by a transverse bar 15.

Figure 5:
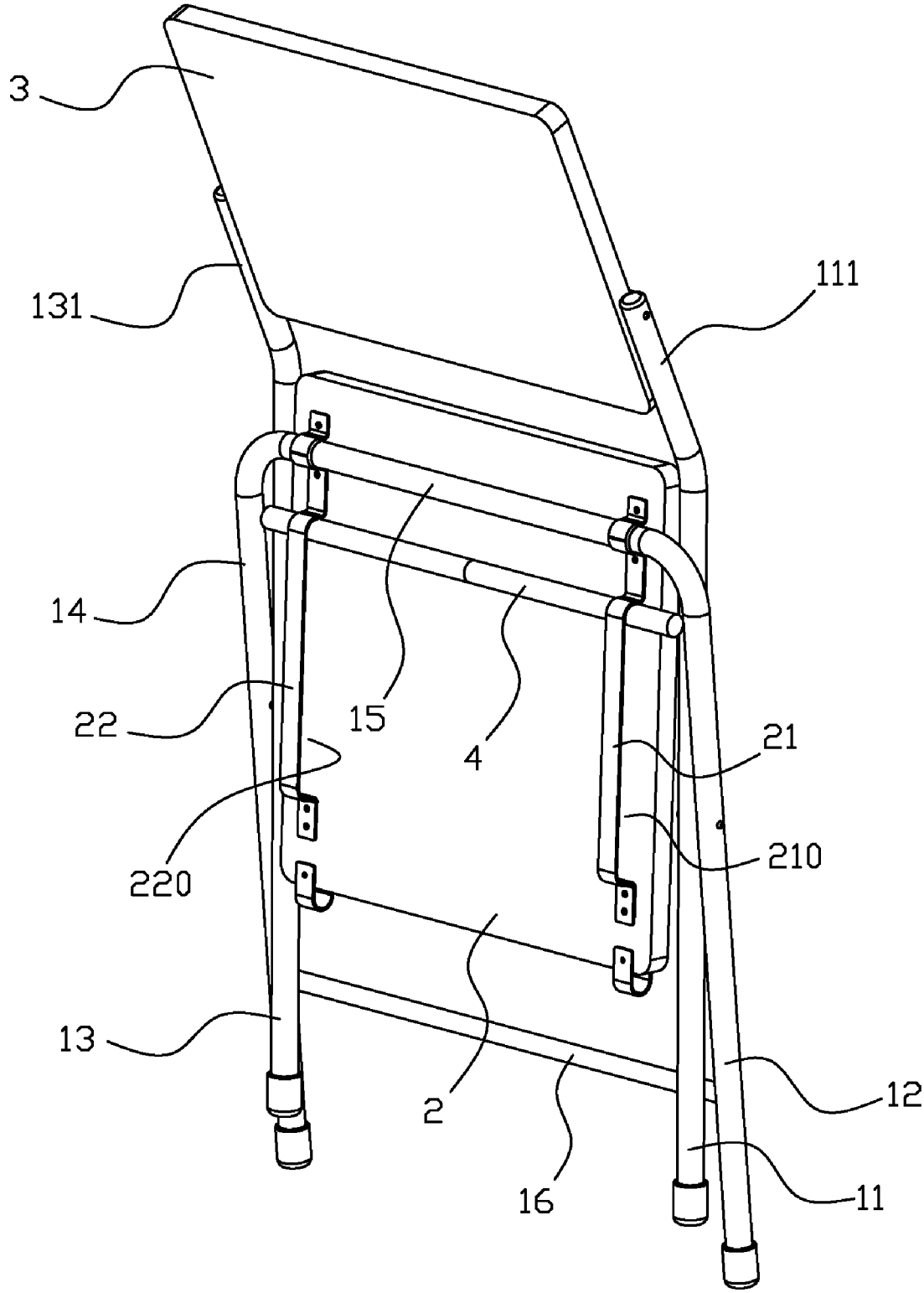
FIG. 5 is a perspective view of the present invention in embodiment 1, shows the folded state.

The seat 2 is a rectangle, without limitation, the other shape is also applicable, the parallel front side and rear side formed the first side and second side of the seat 2 respectively, referring to FIG. 5, two bar-shaped members 21, 22 are disposed in the bottom of the left side and right side of the seat 2 respectively and formed two sliding groove 210, 220 with the seat 2 thereof. A supporting bar 4 pass through the two sliding groove 210, 220, and the supporting bar 4 extending along the left-right direction and can slide along the front-rear direction in the sliding groove 210, 220.

The transverse bar 15 disposed in the upper portion of the two front legs 12, 14 is pivotally connected in the bottom of the front side (i.e. the first side) of the seat 2, the two ends of the supporting bar 4 which can slide along the front-rear direction in the sliding groove 210, 220 are fixed to the upper portion of the two rear legs 11, 13 by welding.

Figure 3:
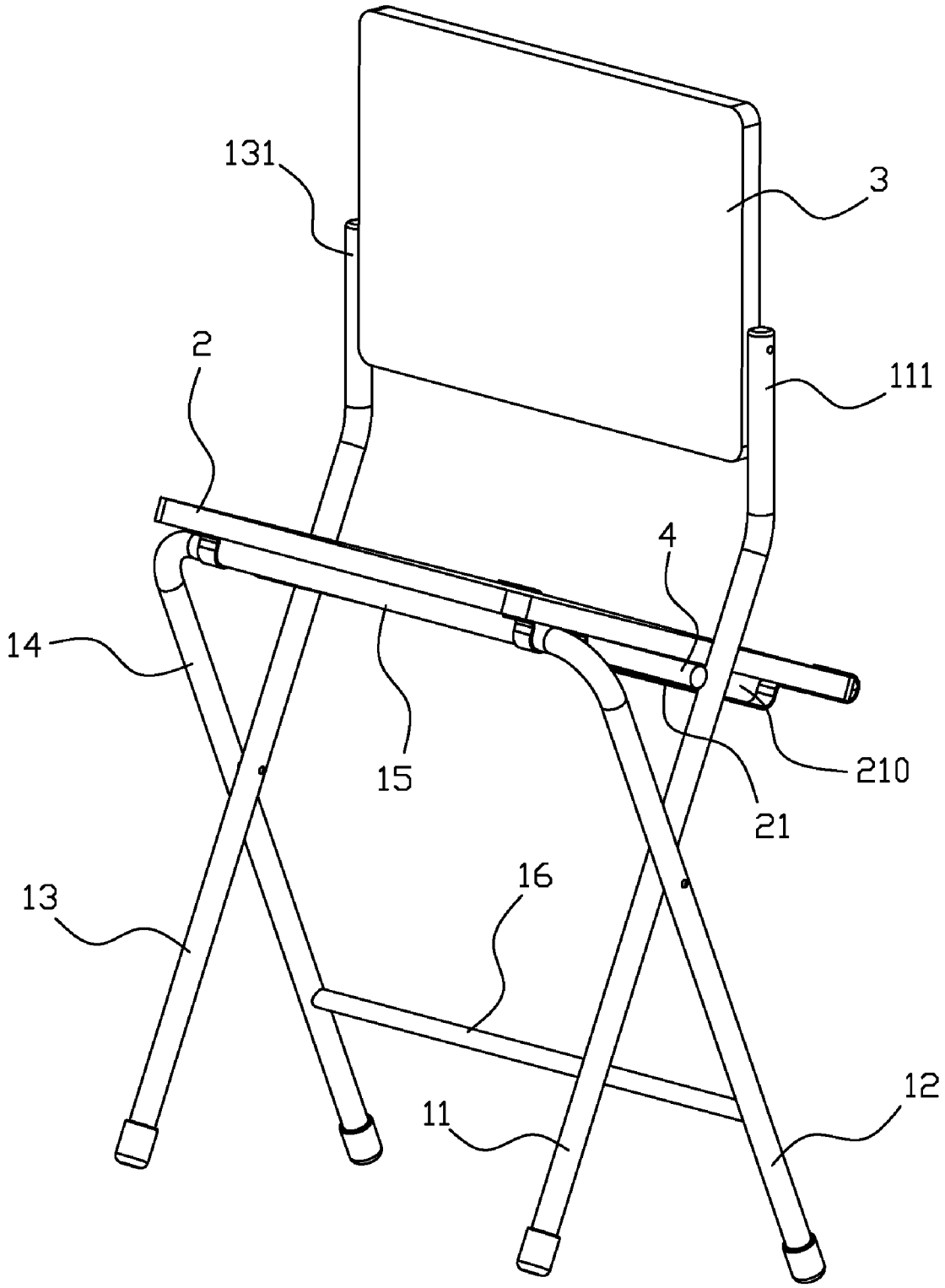
FIG. 3 is a perspective view of the present invention in embodiment 1, shows a position in the folding process.

Referring to FIG. 3 and FIG. 5, the two front legs 12, 14 is in the outside of the two rear legs 11, 13, the length of the supporting bar 4 is larger than the distance between the two rear legs 11, 13 and smaller than the distance between the two front legs 12, 14, therefore, the supporting bar 4 will not effect the folding process.

Referring to FIG. 1 and FIG. 2, in use state, the supporting bar 4 slide to the most-rear position of the sliding groove 210, 220, the cross folding supporting frame 1 is in completely unfolded status to form a stable supporting structure with seat 2. The force pressed on the seat 2 is transferred to the cross folding supporting frame 1 via the transverse bar 15 and the supporting bar 4, this is reasonably and avoid the concentrate pressure.

Figure 4:
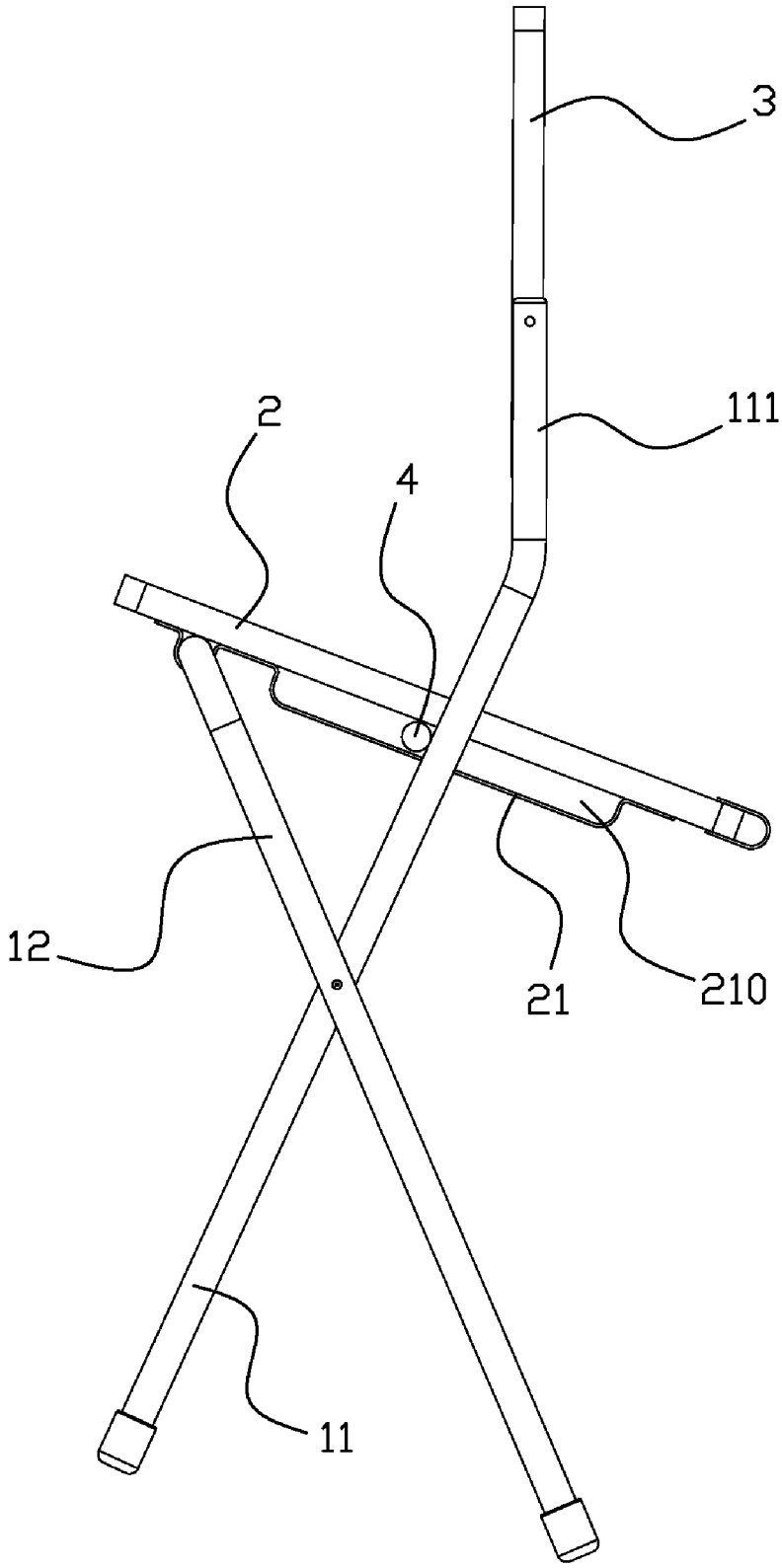
FIG. 4 is a side view of the present invention in embodiment 1, shows a position in the folding process.
Figure 6:
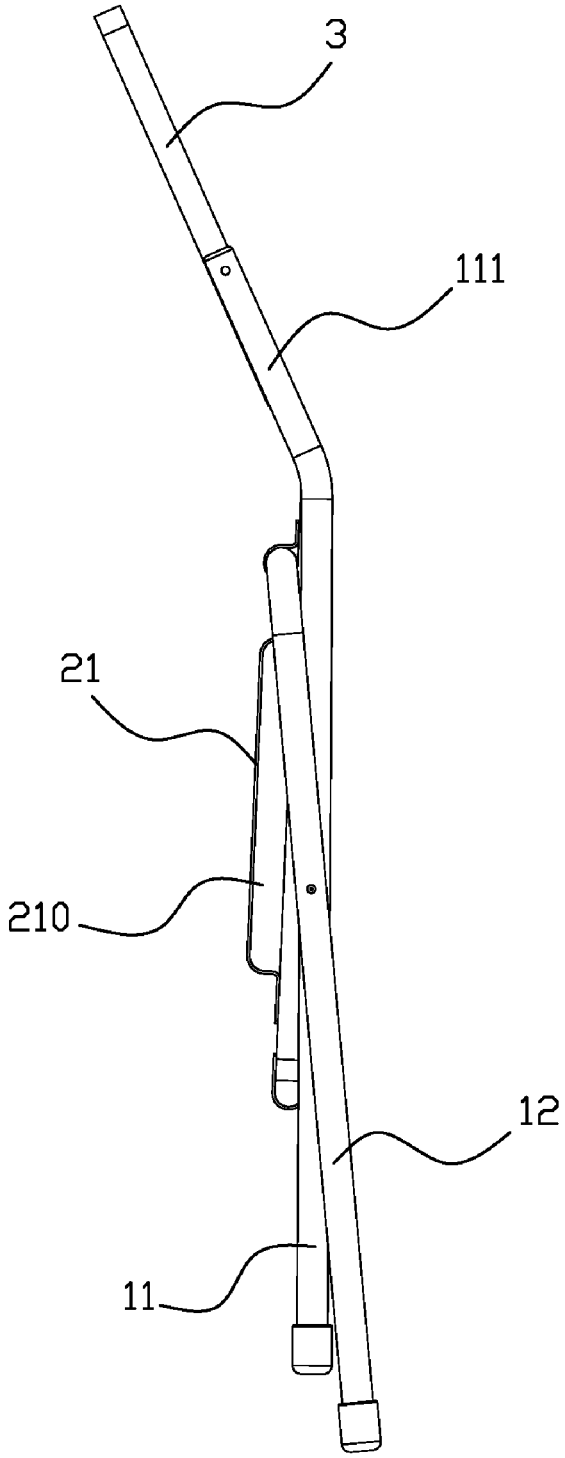
FIG. 6 is a side view of the present invention in embodiment 1, shows the folded state.

In folding, referring to FIG. 3 and FIG. 4, fold the first upper portion and second upper portion of the cross folding supporting frame 1 by a force, the supporting bar 4 will slide to front along the sliding groove 210, 220. After being folded, referring to FIG. 5 and FIG. 6, the supporting bar 4 slide to the most front of the sliding groove 210, 220, the cross folding supporting frame 1 is in completely folded status.

Embodiment 2

Figure 7:
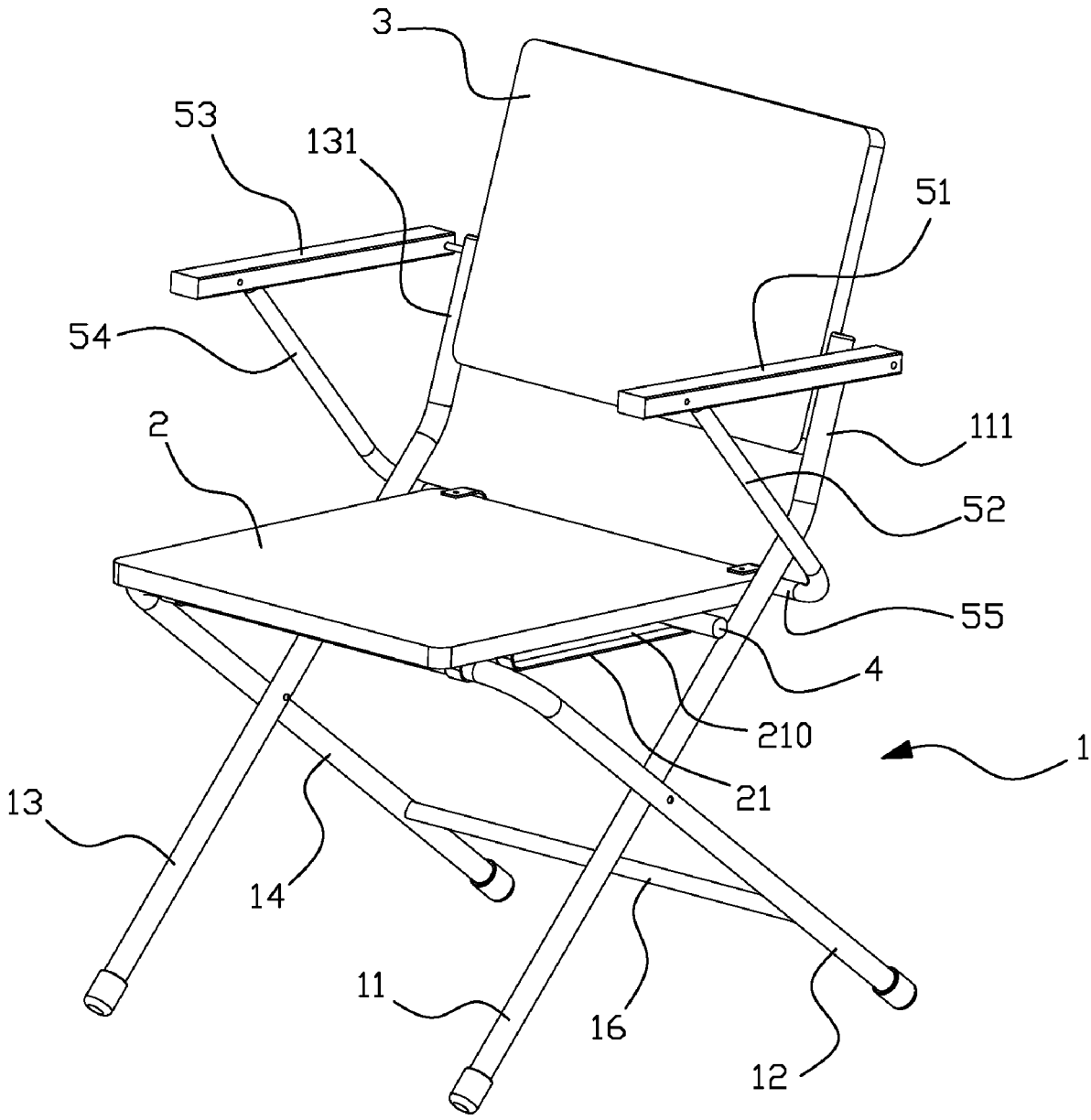
FIG. 7 is a perspective view of the present invention in embodiment 2, shows the using state.
Figure 8:
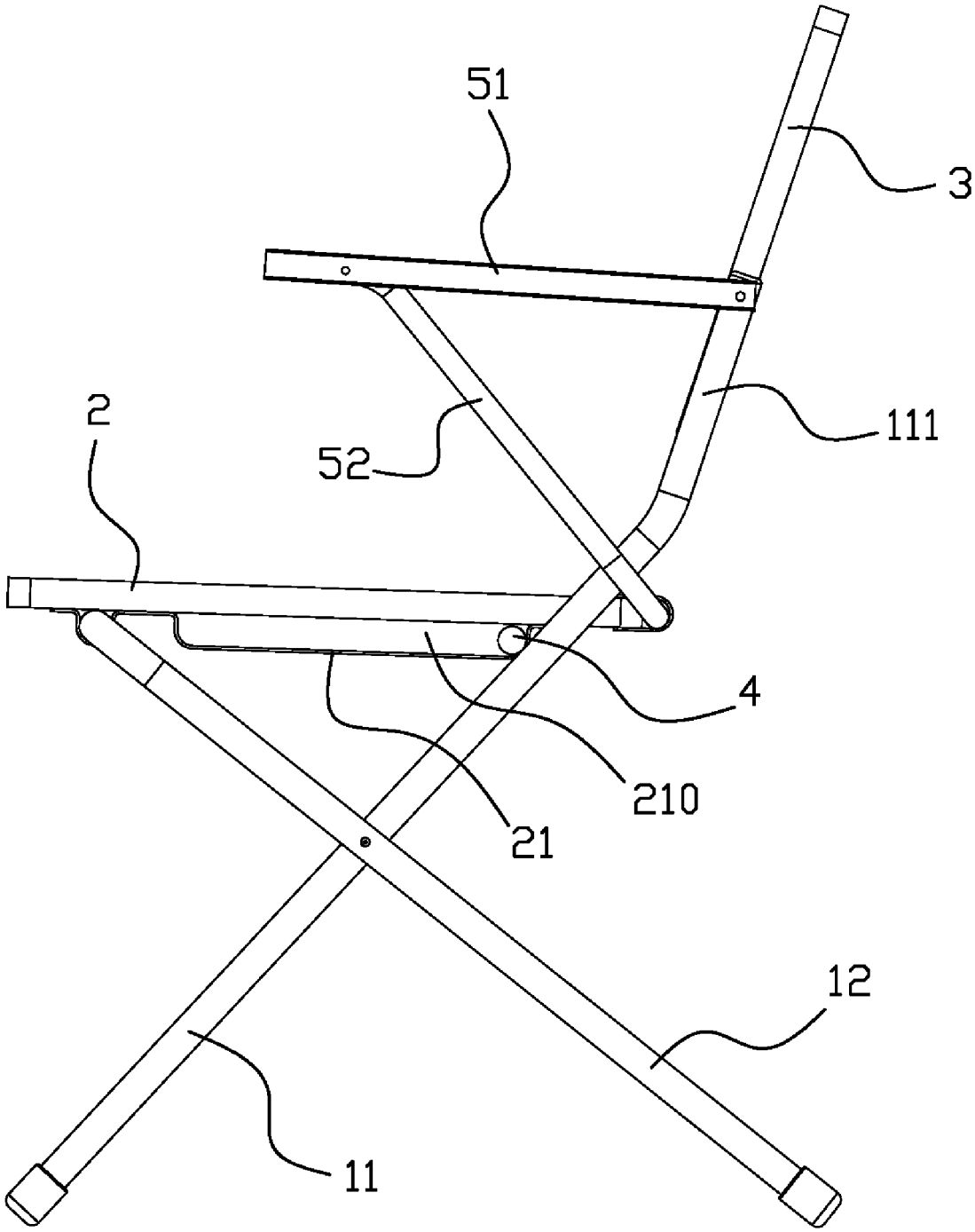
FIG. 8 is a side view of the present invention in embodiment 2, shows the using state.
Figure 9:
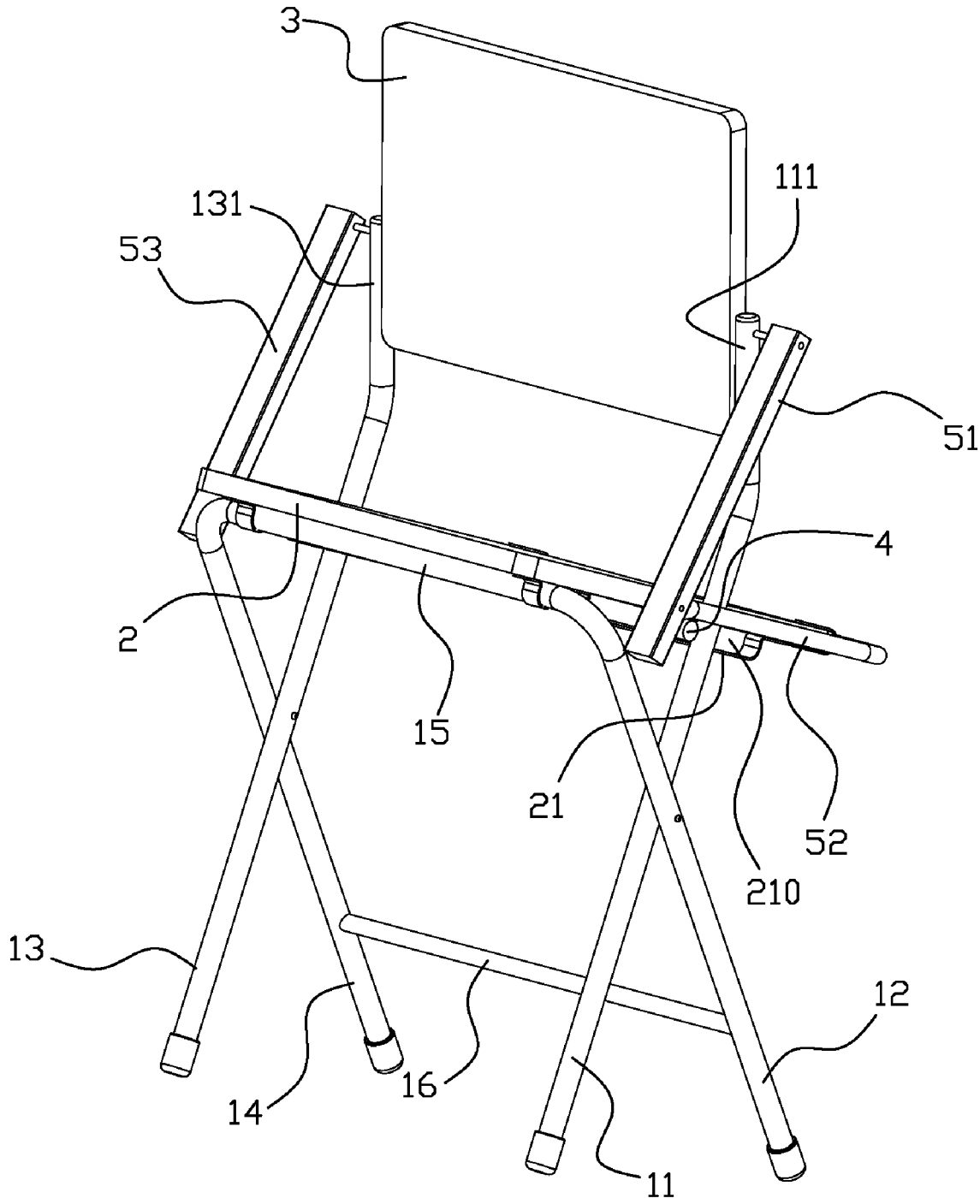
FIG. 9 is a perspective view of the present invention in embodiment 2, shows a position in the folding process.
Figure 10:
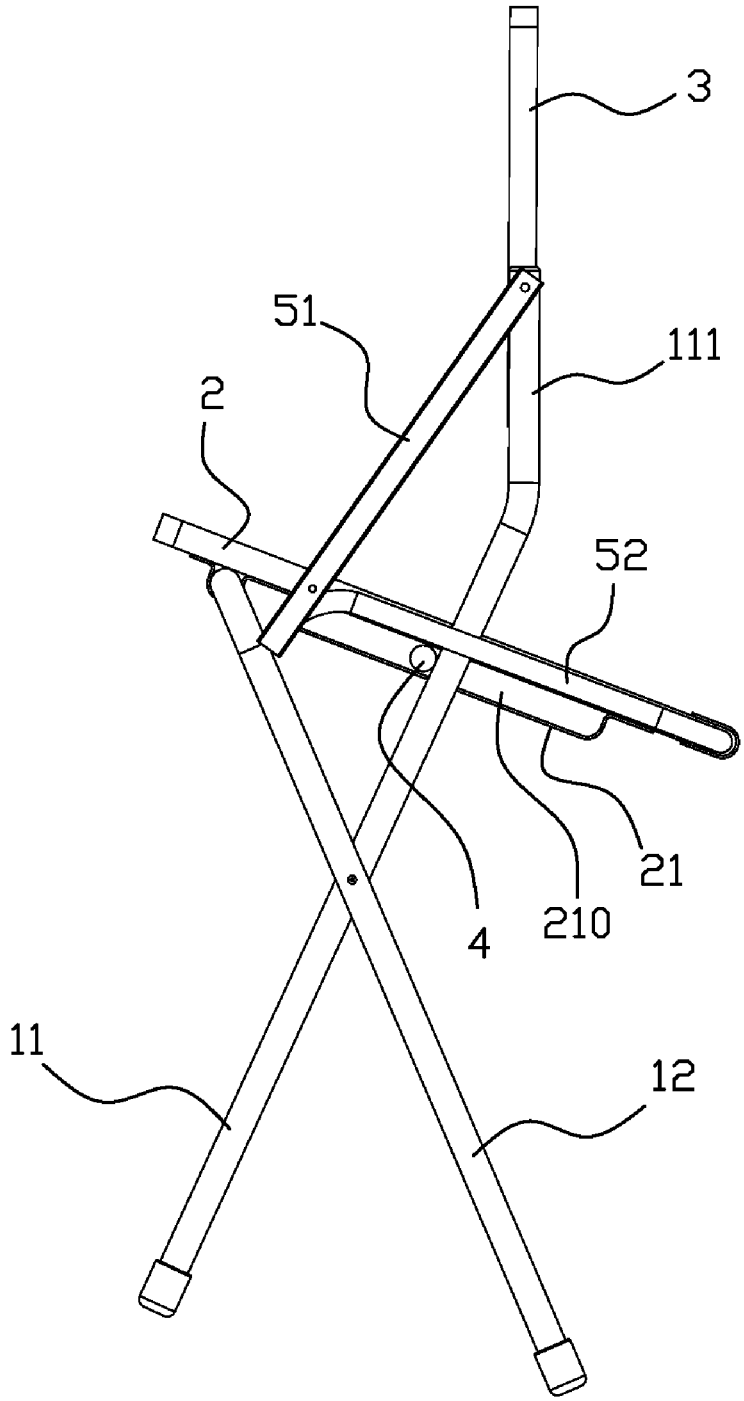
FIG. 10 is a side view of the present invention in embodiment 2, shows a position in the folding process.
Figure 11:
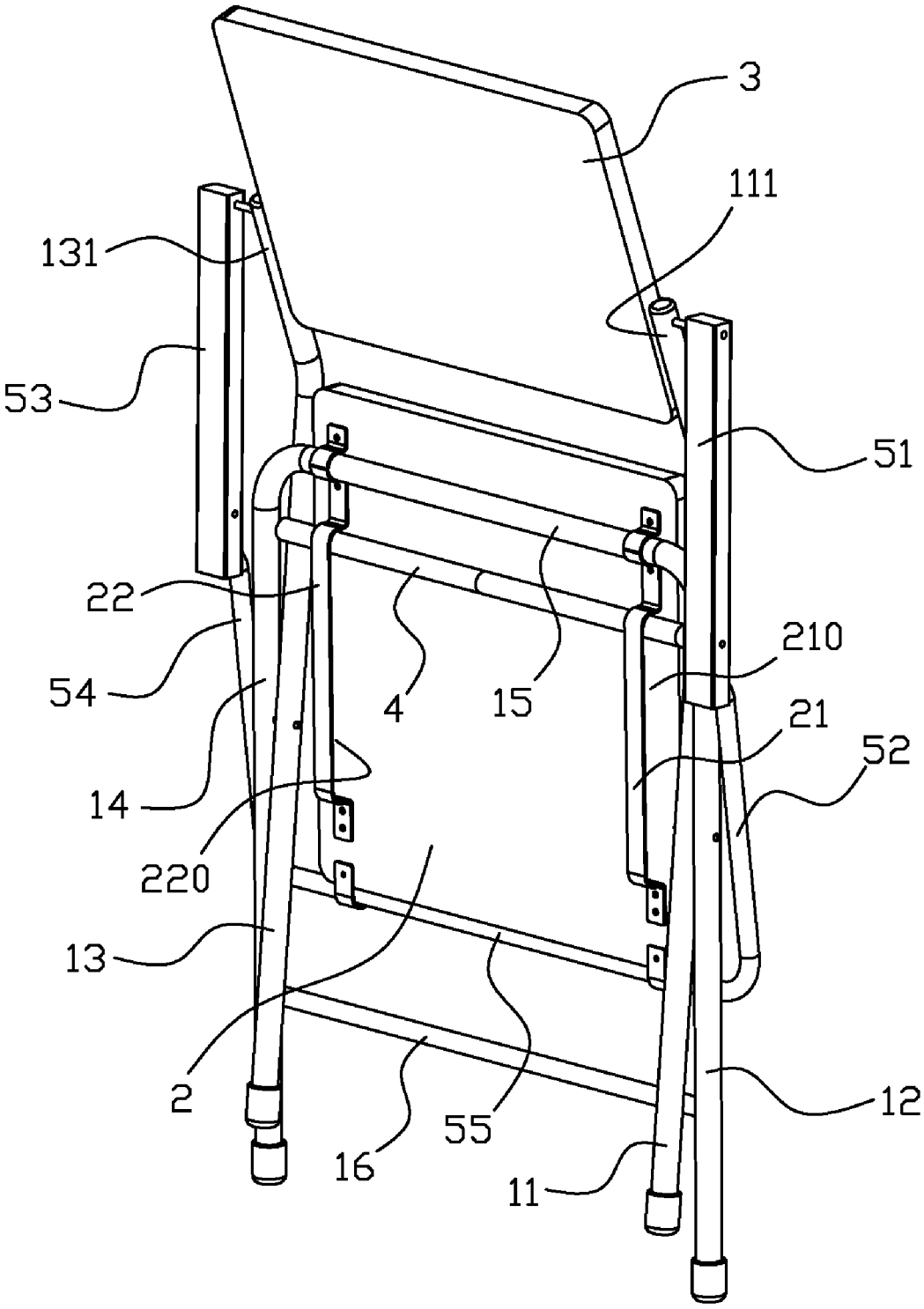
FIG. 11 is a perspective view of the present invention in embodiment 2, shows the folded state.
Figure 12:
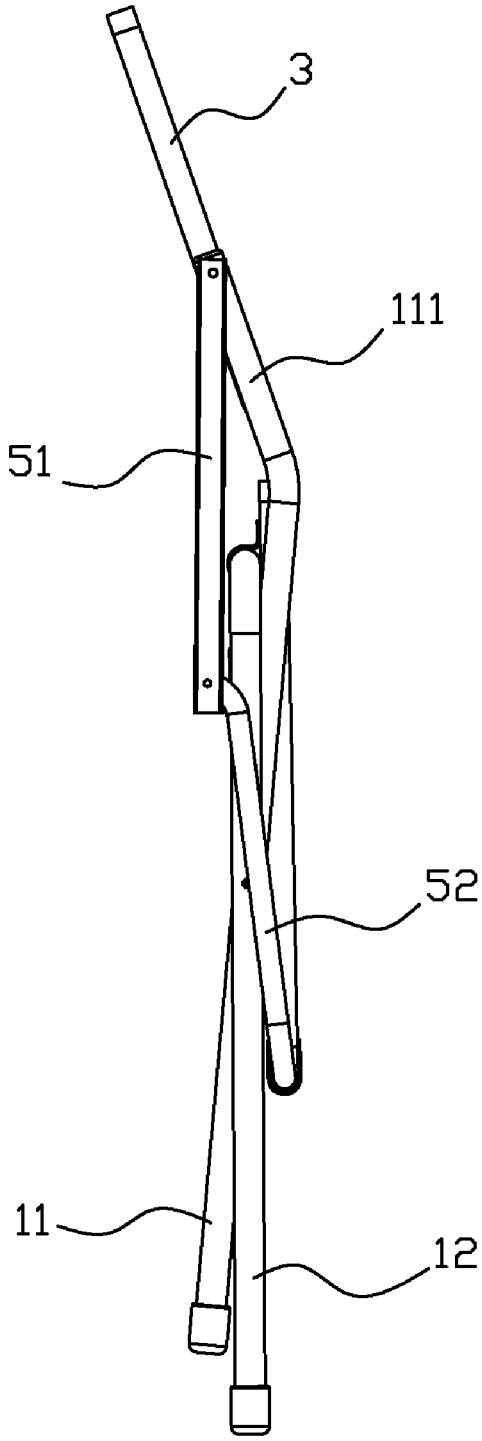
FIG. 12 is a side view of the present invention in embodiment 2, shows the folded state.

The primary structure of this embodiment is the same as embodiment 1, and the difference is that in this embodiment further comprises an armrest structure, the same structure will not be described here for the sake of brevity, and hereinafter the structure of the armrest is described:

Referring to FIG. 7 and FIG. 8, besides the same structure to embodiment 1, this embodiment further comprises two armrest bars 51, 53 and two armrest supporting bars 52, 54, the rear portion of the armrest supporting bars 51, 53 pivotally connected to the back bars 111, 131 respectively, the front end pivotally connected to the upper portion of the armrest supporting bars 52, 54 respectively, the lower end of the armrest supporting bars 52, 54 integrated with each other via a transverse bar 55, the transverse bar 55 pivotally connected to the second side (i.e. rear side) of said seat 2.

The rear end of the two armrest bar 51, 53 pivotally connected to the outside of the two back bar 111, 131 respectively, the two armrest supporting bars 52, 54 pivotally connected to the inner side of the front portion of the two armrest bar 51, 53 respectively, the two rear legs 11, 13 positioned between the left side of said seat 2 and the left armrest supporting bar 52, and between the right side and the right armrest supporting bar 54 respectively to facilitate to be folded.

In folding, referring to FIG. 9 to FIG. 12, the lower portion of the two armrest supporting bars 52, 54 move downwardly with the rear side of the seat 2, the front portions of the two armrest bar 51, 53 be pulled downwardly by the two armrest supporting bars 52, 54, thus the two armrest bar 51, 53 folded downwardly.

Similar to embodiment 1, in embodiment 2, the seat 2 formed slidable and rotatable connection with the two rear legs 11, 13 via a supporting 4. In addition, a sliding groove can be arranged in the left and right sides respectively, and the corresponding position of said rear legs having sliding blocks, said sliding blocks inserted into said sliding grooves to form a slidable and rotatable connecting between said seat and said rear leg. Herein the other possible structures are applicable.

INDUSTRIAL APPLICABILITY

The foldable chair of the present invention has a supporting bar in the bottom of the seat, in use, the pressure of the seat pressed on the upper portion of the two front legs and the supporting bar, and transferred to the two rear legs via the supporting bar, because the supporting bar pass through the bottom of the seat along left-right direction, thus the sustainable pressure of the seat can be increased greatly, therefore, the stability of the foldable chair is improved. The present invention has reasonable design and convenient manufacture.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A foldable chair, comprising:

a cross folding supporting frame comprising a pair of X-shaped cross folding bars, each comprising a front leg and a rear leg connected to each other at respective middle portions thereof, upper portions of the two rear legs forming a first upper portion, upper portions of said two front legs forming a second upper portion, the upper portions of said two front legs extending upwardly to form two back bars;

a back cushion disposed between said two back bars;

a seat having a first side and a second side which are parallel to each other, said first side or near said first side being pivotally connected to the first upper portion of said cross folding supporting frame, a left side and a right side of said seat forming a slidable and rotatable connection with said two front legs respectively;

armrest bars and armrest supporting bars, a the rear end of each armrest bar being pivotally connected to a respective back bar, a front end being pivotally connected to an upper portion of a respective armrest supporting bar, a lower end of said armrest supporting bars being pivotally connected to the second side of said seat; and a further supporting bar disposed at a bottom of said seat and being slidable between said first side and second side, two ends of said further supporting bar being connected to the second upper portion of said cross folding supporting frame;

wherein when the foldable chair is in the unfolded position, said further supporting bar supports the seat to maintain the seat in a horizontal level position.

2. The foldable chair according to claim 1, wherein the two ends of said further supporting bar are welded on the upper portions of said two front legs.

3. The foldable chair according to claim 1, wherein the left and right side of said seat each has a respective sliding groove, and each said front leg has a sliding block insertable into a respective sliding groove to form a slidable and rotatable connection between said seat and said front leg.

4. The foldable chair according to claim 1, wherein the rear end of each said armrest bar is pivotally connected to an outside of said two back bars respectively, an upper end of each armrest supporting bar being pivotally connected to an inner side of a respective armrest bar.

5. The foldable chair according to claim 4, wherein the first side and second side of said seat are the front side and rear side of the seat respectively, the lower ends of said two armrest supporting bars are integrated with each other via a transverse bar, said transverse bar being rotatably connected to the second side of said seat, the two front legs being positioned between the left side of said seat and the left armrest supporting bar, and between the right side of said seat and the right armrest supporting bar, respectively.

* * * * *